US008699669B2

(12) United States Patent
Yuan

(10) Patent No.: US 8,699,669 B2
(45) Date of Patent: Apr. 15, 2014

(54) COLLIMATOR FOR X-RAY IMAGING APPARATUS AND THE ASSEMBLE AND DISASSEMBLE METHOD THEREOF

(75) Inventor: Ping Yuan, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 376 days.

(21) Appl. No.: 13/303,487

(22) Filed: Nov. 23, 2011

(65) Prior Publication Data

US 2012/0134476 A1 May 31, 2012

(30) Foreign Application Priority Data

Nov. 26, 2010 (CN) ..... 2010 1 0576003

(51) Int. Cl.
*G21K 1/02* (2006.01)
*G21K 1/04* (2006.01)

(52) U.S. Cl.
CPC ... *G21K 1/02* (2013.01); *G21K 1/04* (2013.01)
USPC ..... 378/147

(58) Field of Classification Search
CPC ..... G21K 1/02; G21K 1/025; G21K 1/04; G21K 1/046
USPC ..... 378/147; 250/505.1
See application file for complete search history.

(56) References Cited

U.S. PATENT DOCUMENTS

| | | | | |
|---|---|---|---|---|
| 4,246,488 | A * | 1/1981 | Hura | 378/151 |
| 7,519,157 | B2 | 4/2009 | Hockersmith et al. | |
| 7,769,128 | B2 | 8/2010 | Ratzmann | |
| 2011/0096895 | A1 | 4/2011 | Kurochi | |

* cited by examiner

*Primary Examiner* — Courtney Thomas
(74) *Attorney, Agent, or Firm* — Armstrong Teasdale LLP

(57) ABSTRACT

A collimator for X-ray imaging apparatus is provided. The collimator includes a collimator housing including a tube flange, a tube, a locating ring configured to be mounted at an outlet of the tube flange, and at least one tongue set fixed on the locating ring. An outstretching direction of the tongue is towards a center of the locating ring.

20 Claims, 3 Drawing Sheets

COLLIMATOR FOR X-RAY IMAGING APPARATUS AND THE ASSEMBLE AND DISASSEMBLE METHOD THEREOF

CROSS REFERENCE TO RELATED APPLICATIONS

This application claims the benefit of Chinese Patent Application No. 201010576003.1 filed Nov. 26, 2010, which is hereby incorporated by reference in its entirety.

BACKGROUND OF THE INVENTION

The embodiments described herein relate to an interface device, in particular to an mechanical trigger interface device for use in the collimator for an X-ray imaging apparatus, a collimator including the interface device and the assemble and disassemble method thereof.

In various X-ray imaging apparatuses such as CT scanning and imaging apparatuses, the mechanical interface of the collimator directly relates to the safety of the suspending weight (e.g. fall of collimator), the satisfactory of users and the service cost. However, in the conventional X-ray imaging apparatus, usually a bolt is used to connect the collimator to the flange of the tube. Such a way of connection requires certain tightness and torque and generally requires the use of an adhesive, besides, the process and effect of installation are invisible. In addition, factors like mis-operation and loose or aging and fractured bolt will result in a collimator fall in practical application and will thus cause accidents.

Therefore, a safer interface device for collimator that can be easily installed and can reduce the risk of collimator fail is needed.

SUMMARY OF THE INVENTION

The embodiments described herein provide a safe and reliable mechanical trigger interface device of a collimator that can be easily assembled and dissembled, a collimator including the interface device, and the assemble and dissemble method thereof so as to overcome the defects in the prior art.

According to a first aspect, a mechanical trigger interface device of a collimator is provided. The interface device includes a locating ring configured to mount at the outlet of the tube flange on the collimator housing; and a tongue set fixed on the locating ring, wherein the outstretching direction of the tongue is towards the center of the locating ring.

According to one embodiment, the tongue set further includes a tongue set housing with a tongue outlet provided on one end face thereof; a tongue located in the tongue set housing and including a head that can pop out from the tongue and a tail that has a pullback section; and a trigger pin for controlling popping out of the tongue.

According to one embodiment, the tongue set further includes a block plate, which is connected to an end of the tongue set housing opposite to the tongue outlet for covering the pullback section provided at the tongue tail.

Preferably, according to one embodiment, the mechanical trigger interface device of a collimator includes at least three tongue sets which are uniformly disposed on the locating ring.

According to one embodiment, the mechanical trigger interface device of a collimator further includes a rotating lock knob, which is provided on the locating ring for controlling rotation of the collimator.

According to a second aspect, a collimator for X-ray imaging apparatus is provided. The X-ray imaging apparatus includes a collimator housing and a tube. In addition, the collimator further includes a locating ring configured to be mounted at the outlet of the tube flange on the collimator housing; and a tongue set which is fixed on the locating ring, wherein the outstretching direction of the tongue is towards the center of the locating right.

According to one embodiment, the tongue set further includes a tongue set housing with a tongue outlet provided on one end face thereof; a tongue located in the tongue set housing and includes a head that can pop out from the tongue and a tail that has a pullback section; and a trigger pin for controlling popping out of the tongue.

According to one embodiment, the tongue set further includes a block plate, which is connected to an end of the tongue set housing opposite to the tongue outlet for covering the pullback section provided at the tongue tail.

Preferably, according to one embodiment, the collimator includes at least three tongue sets which are uniformly disposed on the locating ring.

According to one embodiment, the tongue set further includes a rotating lock knob, which is provided on the locating ring for controlling rotation of the collimator.

According to a third aspect, a method of assembling the collimator for use in a CT scanning and imaging apparatus according to the second aspect is provided. The method includes rotating the operation platform system to the assembling position to place the tube and the tube flange in position; placing the collimator in the assembling position and pressing the trigger pin; and mounting the block plate.

According to a fourth aspect, a method of disassembling the collimator for use in a CT scanning and imaging apparatus according to the second aspect is provided. The method includes rotating the operation platform system to the disassembling position; removing the block plate; pulling back the tongue; and moving the collimator away from the operation platform system.

According to a fifth aspect, an X-ray imaging apparatus is provided. The X-ray imaging apparatus includes the mechanical trigger interface device of a collimator according to the first aspect or the collimator for X-ray imaging apparatus according to the second aspect.

In the mechanical trigger interface device of a collimator, the collimator includes the interface device, and the assemble and disassemble method thereof, the tube flange is reliably connected to the collimator without using any special assembling tool or adhesive, so the assembling is convenient and time-saving. On the contrary, a tool is needed when disassembling it, thus ensuring a reliable locking during operation of the collimator.

The present invention will be described in detail below by means of embodiments and in conjunction with the drawings, wherein the same or similar components are indicated by the same reference numbers.

DETAILED DESCRIPTION OF THE INVENTION

Figure 1:
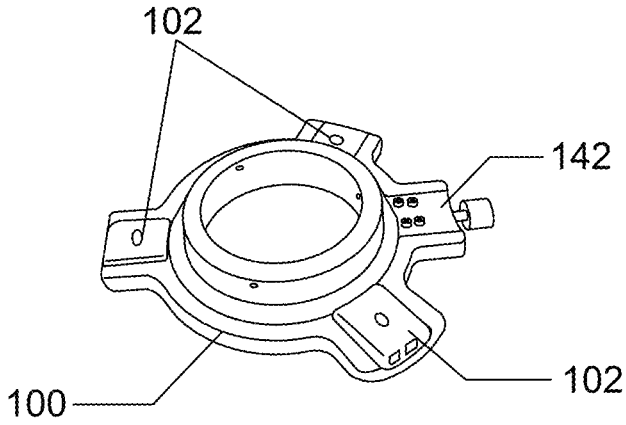
FIG. 1 is a schematic drawing of exemplary embodiment of a mechanical trigger interface device of a collimator.
Figure 2:
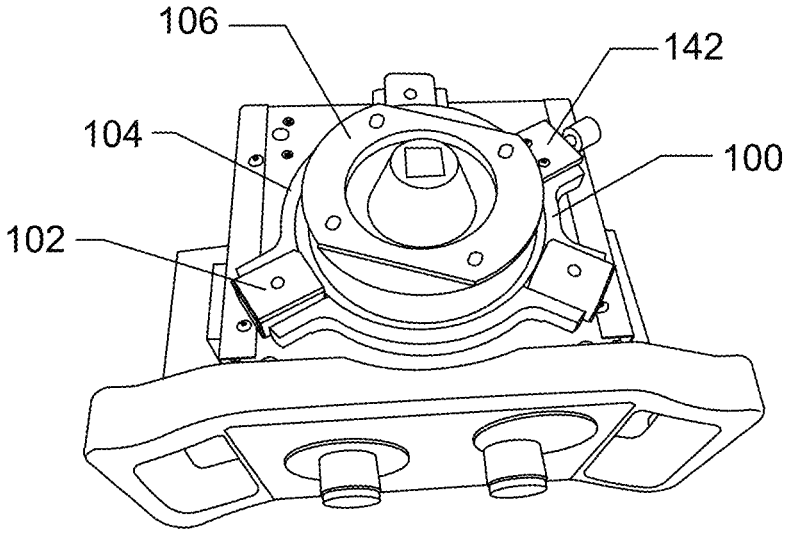
FIG. 2 is a schematic drawing of the collimator includes the mechanical trigger interface device of a collimator.

As shown in FIG. 1, which shows a schematic drawing of the mechanical trigger interface device of a collimator including a locating ring 100 and a tongue set 102. The locating ring is configured to be adapted to mounting at the outlet of the tube flange 106 on the collimator housing 104. For example, the size of the locating ring 100 is configured to be adapted to the size of the outlet of the tube flange 106, as shown in FIG. 2. The tongue set is adapted to be fixed on the locating ring 100, for example, by bolting, riveting, jointing, bonding, etc. The outstretching direction of the tongue is towards the center of the locating ring, namely, towards the tube flange 106, as shown in FIG. 2.

Figure 3:
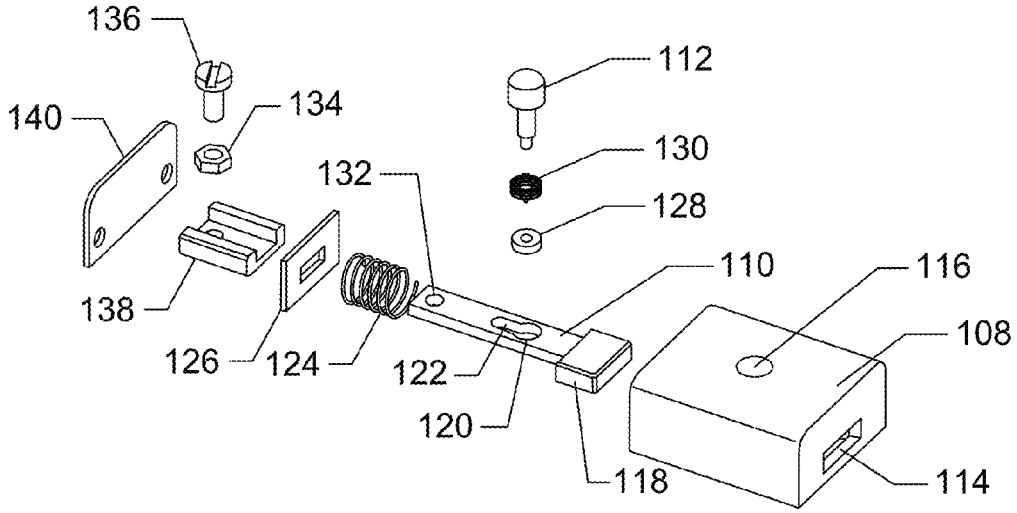
FIG. 3 is an exploded view of the structure of the tongue set.

As shown in FIG. 3, in one embodiment, the tongue set 102 further includes a tongue set housing 108, a tongue 110, and a trigger pin 112. The tongue set housing 108 is substantially a cuboid, with one end face thereof being provided with a tongue outlet 114 and one side face thereof being provided with a trigger pin hole 116.

The tongue 110 can be assembled into the tongue set housing 108, and can be configured in such a way that its head 118 can pop out from the tongue outlet 114 and its tail has a pullback section. A locating hole 120 is provided on the tongue 110 as well as a slotted hole 122 connected to the locating hole 120. The locating hole 120 is wider than the slotted hole 122. The head 118 of the tongue is made to be wider than the rest parts of the tongue, so that after nesting the driving spring 124 into the tongue 110, the tail of the tongue 110 passes through the opening on the block plate 126 that can allow its passage and is assembled into the tongue set housing 108.

The trigger pin 112 is made to be adapted to mounting into the trigger pin hole 116 on the tongue set housing 108. In other words, after being mounted, the trigger pin 112 can move up and down in the trigger pin hole 116 when being pressed so as to control the pop out of the tongue 110. Specifically, a locating section 128 (e.g. including but not limited to a nut that can be connected to the lower part of the trigger pin 112) is provided at the lower part of the trigger pin 112. The dimension of the locating section 128 is greater than the width of the slotted hole 122, but is adapted to be inserted into the locating hole 120 on the tongue 110. The body of the trigger pin 112 is thinner than the locating section 128 so as to be movable in the slotted hole 122. In addition, a trigger sprint 130 is in socket joint with the body of the trigger pin 112.

Figure 4:
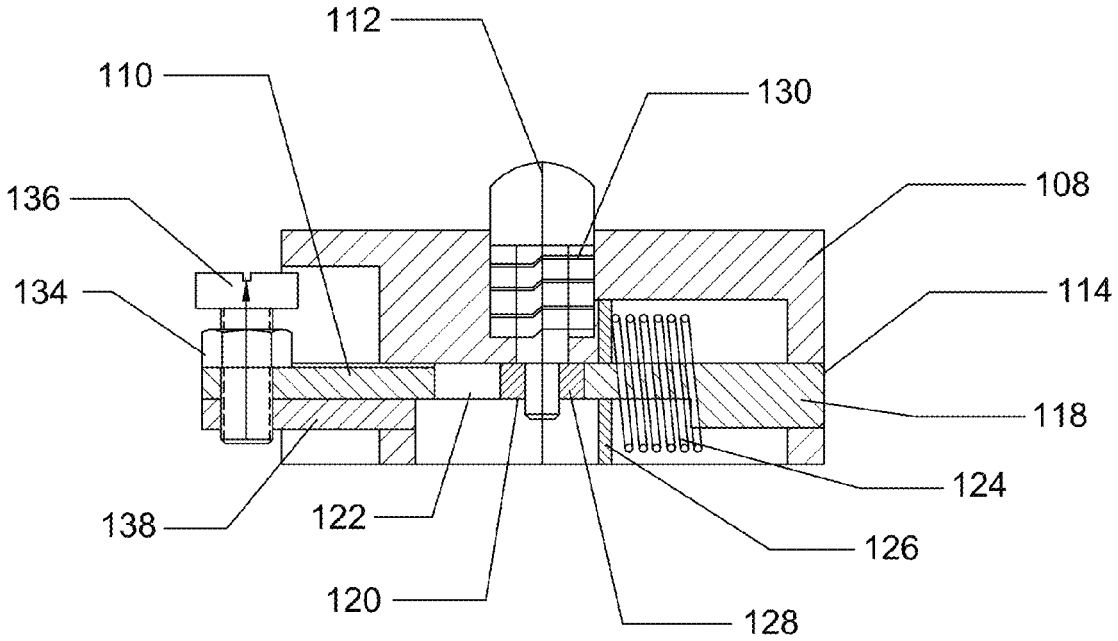
FIG. 4 is a section view of the tongue set, which shows the state in which the tongue is not popped out.

As shown in FIG. 4, after mounting, the locating section 128 at the lower part of the trigger pin 112 is in the locating hole 120 on the tongue 110, the driving spring 124 is compressed between the head 118 of the tongue and the block plate 126, the trigger spring 130 is in a natural state, and the tongue 110 is in a retracting state at this time. When the trigger pin 112 is pressed, the locating section 128 at the lower part of the trigger pin 112 is detached downwards from the locating hole 120 on the tongue 110, and the tongue 110 is popped out from the tongue outlet 114 under the force of the driving spring 124. The popping length mainly depends on the length of the slotted hole 122, so an appropriate tongue popping length can be obtained by properly setting the length of the slotted hole 122. Meanwhile, the trigger spring 130 is compressed, as shown in FIG. 5.

Figure 6:
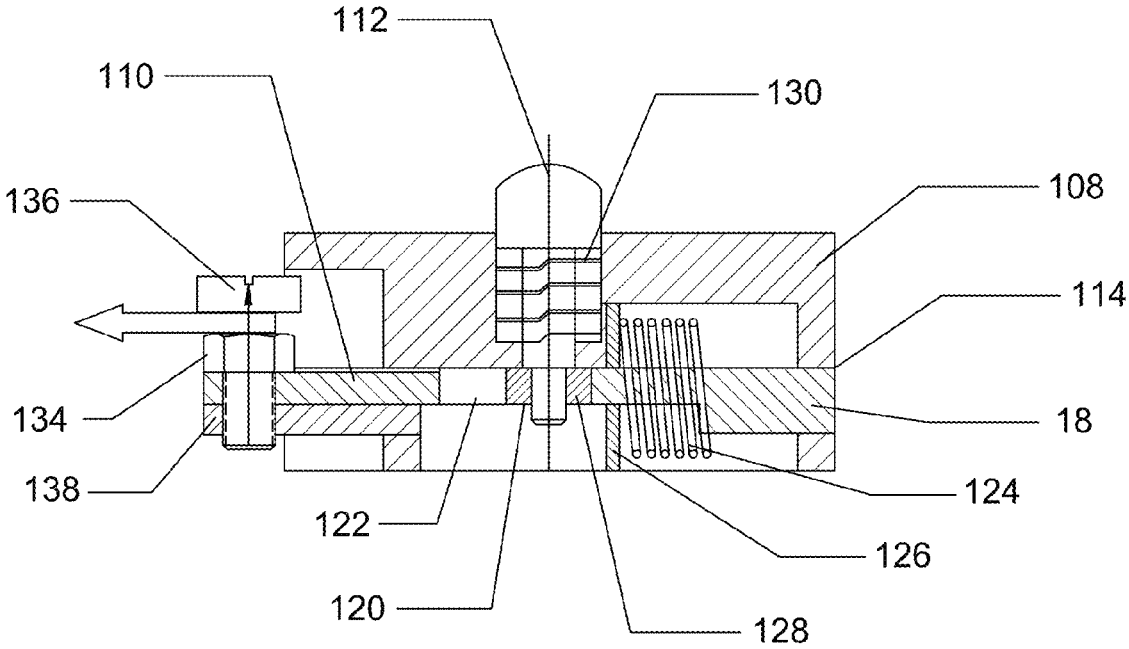
FIG. 6 is a section view of the tongue set, which shows the state in which the tongue is pulled back.

Furthermore, a pull back section is provided at the tail of the tongue 110. In one embodiment, the pull back section includes a nut 134, a bolt 135, and a tongue tip 138 connected through a screw hole 132 at the tail of the tongue 110, as shown in FIG. 3. When pulling the tongue 110 by the pull back section (as shown by the arrow in FIG. 6), the head 118 of the tongue 110 moves towards the inside of the tongue set housing 108, and the driving spring 12 is compressed. When the locating hole 120 on the tongue is moved to be aligned with the locating section 128 at the lower part of the trigger pin 112, the trigger pin 112 moves upwards under the force of the trigger spring 130, so that the locating section 128 at the lower part of the trigger pin 112 enters the locating hole 120 on the tongue so as to lock the tongue 110, as shown in FIG. 6.

Figure 5:
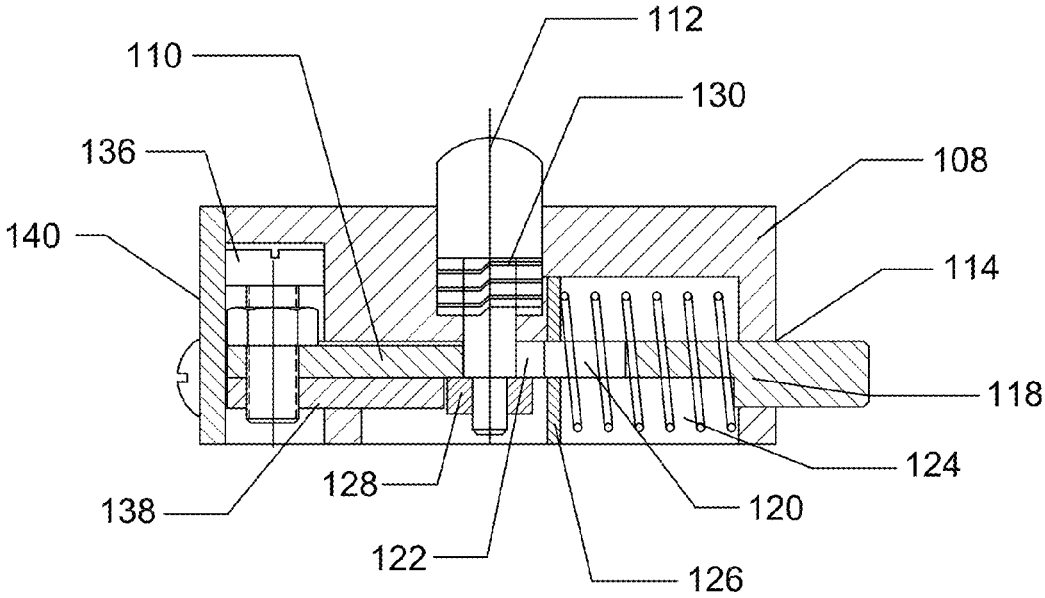
FIG. 5 is a section view of the tongue set, which shows the state in which the tongue is popped out.

As shown in FIGS. 3 and 5, in one embodiment, the tongue set 102 further includes a block plate 140 that can be connected to an end of the tongue set housing opposite to the tongue outlet 114 for covering the pull back section provided at the tail of the tongue, thus preventing mis-operation.

In one embodiment, the mechanical trigger interface device of a collimator includes at least three tongue sets 102 which are uniformly disposed on the locating ring 100. Preferably, the mechanical trigger interface device of a collimator includes three tongue sets which are disposed on the locating ring with an interval of 120° between each other, as shown in FIGS. 1 and 2.

In one embodiment, the mechanical trigger interface device of a collimator further includes a rotating lock knob 142, which is provided on the locating ring 100 for controlling rotation of the collimator, as shown in FIGS. 1 and 2.

FIG. 2 is a schematic drawing of the collimator including the mechanical trigger interface device of a collimator according to the above embodiment. The locating ring 100 is mounted at the outlet of the tube flange 106 on the collimator housing 104 by bolting, riveting or other connection means. Likewise, the three tongue sets 102, for example, are mounted onto the locating ring 100. After pressing the trigger pin 112 on the tongue set 102, the tongue 110 outstretches towards the center of the locating ring to be against the tube flange 106 so as to fix it at the central position.

The mechanical trigger interface device of a collimator according to the above embodiments makes it easy to install the collimator and prevents mis-disassembling. The assembling process mainly includes the following steps: rotating the operation platform system to the assembling position to place the tube and the tube flange in position; placing the collimator in the assembling position and pressing the trigger pin; and mounting the block plate. Correspondingly, the disassembling process mainly includes the steps of rotating the operation platform system to the disassembling position; removing the block plate; pulling back the tongue; and moving the collimator away from the operation platform system.

The mechanical trigger interface device of a collimator according to the above embodiments or the collimator including the interface device can be used in an X-ray scanning and imaging apparatus. Since this can be easily realized by those skilled in the art, it is not described in detail herein.

While the present invention has been described in detail by specific embodiments, it is not limited to the specific embodiments. Those skilled in the art shall understand that various modifications, equivalent substitutions and changes can be made to the present invention, for example, the trigger spring can be provided between the lower part of the trigger pin and the bottom face of the tongue set housing, or the driving spring can be provided at the tail end of the tongue.

A bayonet can be provided at a side of the tongue, so that the tongue is popped out or locked by poking the trigger pin. Such variations, however, should fall within the protection scope of the present invention as long as they are not departing from the spirit of the present invention. In addition, some terms used in the description and claims of the present application, for example "on" and "under" and so on are not intended to limit but to facilitate the description. Moreover, expressions like "one embodiment" and "another embodiment" used in the above texts indicate different embodiments, but of course, they can be implemented, all or in part, in one embodiment.

What is claimed is:

1. A collimator for X-ray imaging apparatus, said collimator comprising:

a collimator housing including a tube flange;

a tube;

a locating ring configured to be mounted at an outlet of the tube flange; and at least one tongue set fixed on the locating ring, wherein an outstretching direction of the tongue is towards a center of the locating ring.

2. The collimator according to claim 1, wherein the at least one tongue set further comprises:

a tongue set housing including a tongue outlet on a first end face thereof;

a tongue in the tongue set housing and including a head configured to move out from the tongue and a tail having a pullback section; and a trigger pin configured to control the movement of the tongue head.

3. The collimator according to claim 2, further comprising a block plate connected to a second end face of the tongue set housing opposite to the first end face, the block plate configured to cover the pullback section of the tongue tail.

4. The collimator according to claim 1, further comprising at least three tongue sets uniformly disposed about the locating ring.

5. The collimator according to claim 2, further comprising at least three tongue sets uniformly disposed about the locating ring.

6. The collimator according to claim 3, further comprising at least three tongue sets uniformly disposed about the locating ring.

7. The collimator according to claim 1, further comprising a rotating lock knob on the locating ring, the rotating lock knob configured to control a rotation of the collimator.

8. The collimator according to claim 2, further comprising a rotating lock knob on the locating ring, the rotating lock knob configured to control a rotation of the collimator.

9. The collimator according to claim 3, further comprising a rotating lock knob on the locating ring, the rotating lock knob configured to control a rotation of the collimator.

10. A method for assembling and disassembling the collimator for X-ray imaging apparatus according to claim 1, the method comprising:

an assembling method comprising:

rotating an operation platform system to an assembling position to place the tube and the tube flange in position;

placing the collimator in the assembling position;

pressing a trigger pin; and mounting a block plate; and a disassembling method comprising:

rotating the operation platform system to a disassembling position;

removing the block plate;

pulling back the tongue; and moving the collimator away from the operation platform system.

11. An X-ray imaging apparatus comprising the collimator according to claim 1.

12. A method for assembling and disassembling a collimator for an X-ray imaging apparatus, the collimator including a collimator housing including a tube flange, a tube, a locating ring configured to be mounted at an outlet of the tube flange, and at least one tongue set fixed on the locating ring, wherein an outstretching direction of the tongue is towards a center of the locating ring, said method comprising:

rotating an operation platform system to an assembling position to place the tube and the tube flange in position;

placing the collimator in the assembling position;

pressing a trigger pin; and mounting a block plate.

13. The method according to claim 12, further comprising:

rotating the operation platform system to a disassembling position;

removing the block plate;

pulling back the tongue; and moving the collimator away from the operation platform system.

14. An X-ray imaging apparatus comprising a collimator comprising:

a collimator housing including a tube flange;

a tube;

a locating ring configured to be mounted at an outlet of the tube flange; and at least one tongue set fixed on the locating ring, wherein an outstretching direction of the tongue is towards a center of the locating ring.

15. The X-ray imaging apparatus according to claim 14, wherein the at least one tongue set comprises:

a tongue set housing including a tongue outlet on a first end face thereof;

a tongue in the tongue set housing and including a head configured to move out from the tongue and a tail having a pullback section; and a trigger pin configured to control the movement of the tongue head.

16. The X-ray imaging apparatus according to claim 15, wherein the at least one tongue set further comprises further comprising a block plate connected to a second end face of the tongue set housing opposite to the first end face, the block plate configured to cover the pullback section of the tongue tail.

17. The X-ray imaging apparatus according to claim 16, wherein the at tongue comprises a locating hole and a slotted hole connected to the locating hole, wherein the locating hole is wider than the slotted hole.

18. The X-ray imaging apparatus according to claim 17, wherein the head of the tongue is wider than a remainder of the tongue such that the tail of the tongue passes through an opening on the block plate.

19. The X-ray imaging apparatus according to claim 14, wherein the collimator comprises at least three tongue sets uniformly disposed about the locating ring.

20. The X-ray imaging apparatus according to claim 14, wherein the locating ring comprises rotating lock knob configured to control a rotation of the collimator.

* * * * *